US006920672B1

(12) United States Patent
Hubbard

(10) Patent No.: US 6,920,672 B1
(45) Date of Patent: Jul. 26, 2005

(54) PICTURE BELT BUCKLE

(76) Inventor: Rayford C. Hubbard, 827 Westmount Dr., #4, West Hollywood, CA (US) 90069

( * ) Notice: Subject to any disclaimer, the term of this patent is extended or adjusted under 35 U.S.C. 154(b) by 0 days.

(21) Appl. No.: 10/456,689

(22) Filed: Jun. 5, 2003

Related U.S. Application Data

(60) Provisional application No. 60/385,846, filed on Jun. 5, 2002.

(51) Int. Cl.[7] ..... A44B 11/00

(52) U.S. Cl. ..... 24/163 K; 24/163 R

(58) Field of Search ..... 24/163 K, 198, 24/199, 200, 307, 318, 317; 40/640, 776; 2/321, 322

(56) References Cited

U.S. PATENT DOCUMENTS

| | | | | | |
|---|---|---|---|---|---|
| 954,227 | A * | 4/1910 | Thorne | 40/640 |
| 1,784,794 | A * | 12/1930 | Rosenberg | 24/163 R |
| 3,685,057 | A * | 8/1972 | Foy | 24/307 |
| 4,052,773 | A * | 10/1977 | Nesbitt | 24/163 K |
| 4,170,808 | A * | 10/1979 | Knowles | 24/163 K |
| 4,232,428 | A * | 11/1980 | Johansson | 24/188 |
| 4,502,188 | A * | 3/1985 | Kohli | 24/163 K |
| 4,570,308 | A * | 2/1986 | Weisgerber | 24/163 K |
| 4,691,460 | A * | 9/1987 | Kohl | 40/618 |
| 5,127,136 | A * | 7/1992 | Magnus | 24/176 |
| 5,888,326 | A * | 3/1999 | Shillan et al. | 156/59 |
| 6,182,388 | B1 * | 2/2001 | Patton | 40/640 |

* cited by examiner

*Primary Examiner*—Robert J. Sandy
(74) *Attorney, Agent, or Firm*—Henry M. Bissell

(57) ABSTRACT

A belt buckle having a photograph mounted in a recessed central area which is filled with a cured epoxy resin or ultraviolet radiation curable coating that extends over and adheres to the peripheral edges of the central area and the side surfaces thereof. Methods of fabrication of such a belt buckle are also disclosed.

16 Claims, 1 Drawing Sheet

PICTURE BELT BUCKLE

CROSS-REFERENCE TO RELATED APPLICATION

This application claims the benefit of U.S. Provisional Application No. 60/385,846, filed Jun. 5, 2002.

BACKGROUND OF THE INVENTION

1. Field of the Invention

The present invention generally relates to belt buckles and, more particularly, pertains to methods of fabricating a picture belt buckle by mounting a small photograph along the face of a pre-formed belt buckle and covering the photograph by means of a protective coating. It also relates to the product produced by these fabrication methods.

2. Description of the Related Art

The use of specially formed, decorative belt buckles is common. Some belt buckles of this type are cast or molded with a particular name or initials displayed along the face or integrally formed in the buckle. Unique decorative designs may be affixed along the face of a belt buckle affording a display to members of the public. Belt buckles of the type here envisioned commonly are fabricated with an attachment loop by which the buckle may be attached to a belt which is particularly constructed to facilitate joining of the belt to such a buckle.

A number of belt buckles have been fabricated to accommodate the display of a small photograph, such as is the object of the present invention. U.S. Pat. No. 6,182,388 B1 of Kenneth D. Patton discloses a belt buckle with a removable display insert for displaying an image on the belt buckle. The buckle includes a frame with a central opening and a backing plate mounted to a back face of the frame to retain a decorative insert which is visible through the central opening, much like the way in which snapshots and small photos are retained in picture frames for display.

U.S. Pat. No. 4,067,737 of Anthony Vincent Lewis describes a method of applying a clear resin protective coating to a picture. The method involves spreading the liquid resin by using a spreader sheet under tension in a manner such that a wedge of resin is advanced over the picture surface as the spreader sheet carrier frame is lowered.

U.S. Pat. No. 4,170,808 of Alfred E. Knowles discloses a belt buckle blank having an aluminum face plate that is anodized and which is photosensitive. This structure permits a negative photographic-type image to be exposed and developed on the face plate.

U.S. Pat. No. 4,243,626 of John E. Prete discloses a process for forming a decorative jewelry stone wherein a photographic film image is used as a mold for receiving liquid plastic resin.

U.S. Pat. No. 4,407,932 of Harry A. Loder et al. discloses special photographic paper and a method of preparing an image using such paper.

U.S. Pat. No. 4,570,308 of Robert G. Weisgerber discloses a belt buckle structure with a removable rear covering which permits insertion of a photo or other item for display through the front plate window, not unlike the disclosed product of Patton.

European patent EP 0 824 875 A1 shows a belt buckle structure defining an opening to accept a picture which is to be inserted from one end of the belt buckle.

While these patent disclosures may be of interest to one considering the fabrication of belt buckles of the type involved in the present invention, they are all quite different from the methods of my invention and the products realized thereby.

SUMMARY OF THE INVENTION

In brief, particular arrangements in accordance with the present invention involve a process for the preparation of a special kind of belt buckle in which a small photograph is mounted within a recess in the face of the belt buckle. The mounted photograph is protected against abrasion and wear by means of an applied transparent coating. The thickness of this coating overlying the photograph adds luster and depth to the visual effect of the photo.

In one particular embodiment, the coating is an epoxy resin, applied in liquid form and cured to develop a hard, clear overlayer.

In another particular embodiment of the invention, an ultraviolet radiation curable coating is provided. This may be in the form of a complete coating layer, or it may be formed as a top layer to be applied over an epoxy resin coating.

A number of suitable preformed belt buckle blanks of various sizes and shapes are commercially available. As an example in the practice of this invention, a particular preformed belt buckle blank is utilized as the base and frame for the mounting of the photograph and the subsequent application of the epoxy resin or ultraviolet radiation curable coating to result in the decorative, utilitarian product of my invention.

While an epoxy resin or ultraviolet radiation curable coating may be applied to a belt buckle blank having a small photograph mounted therein, I have found that the epoxy resin or ultraviolet radiation curable coating itself must be properly applied and protected from contact with certain parts of the belt buckle.

One particular embodiment of my invention includes the following steps in the fabrication of a picture belt buckle:

1. Obtain a belt buckle blank, preferably of metal such as brass, for example, of a type having a recessed central display region to receive a photograph. The recessed central area is surrounded by a raised lip or edge extending about the recessed area to frame a picture mounted in the recessed region. The preferred metal belt buckle blank may be a planar element or it may be slightly curved, as is often the case for large, wide buckles. Preferably the belt buckle blank will have a loop extending along the back at one side thereof which is adapted to receive one end of a belt that is configured to fold about the loop and be retained by one or more snaps or a Velcro™ fastener. Near the opposite end of the buckle, also extending from the rear, are one or more rearwardly projecting hooks which are adapted to engage in corresponding holes in the free end of the belt.

The loop which extends along the back of the buckle is attached to the belt buckle blank by suitable affixing means such as, for example, by brazing or by adhesive. Alternatively, it may be fused to the belt buckle blank, in which case both the buckle blank and the loop are formed of a fusible material. In one preferred embodiment, the loop is affixed to the belt buckle blank by brazing at a location on the opposite end of the buckle from the rearwardly projecting hooks. One end of the belt engages the loop by folding that end around the loop. The hook at the opposite end of the buckle is adapted to engage the free end of the belt through a hole which is located along the center line of the belt and through which the rearwardly projecting pin member is inserted.

Buckles which are used in the practice of my invention have a recessed central portion surrounded by a raised lip or edge surrounding the recessed portion. Such buckles are commonly rectangular, square, round or elliptical in shape. After selection of a buckle for use in practicing the invention, the next step is to cut out a picture or other decorative insert to the correct size to fit in the recessed area within the raised lip surrounding it. Succeeding steps in the process of my invention comprise the following:

2. Spray or otherwise apply a coating on the front side of the picture with an ultraviolet-radiation inhibitor to prevent the picture from fading due to exposure to sunlight.
3. Apply a two-sided adhesive tape to the back side of the picture.
4. Remove the belt loop from the back of the belt buckle blank.
5. Sandblast the belt buckle blank clean of all paint and other coating.
6. Use an arbor press to straighten the belt buckle blank to a planar shape.
7. Spray paint the belt buckle blank to a desired color.
8. Apply a clear adhesive-backed tape to the back side of the belt buckle blank and trim the excess tape off flush with the edge of the metal. I have found that regular Scotch™ tape is suitable for this purpose. By using clear tape, one can see if the adhesion to the belt buckle blank is complete so that the liquid resin cannot penetrate under the tape.
9. Apply a bead of silicon around the back edge of the belt buckle blank over the tape.
10. Insert the cut out picture or other decorative element into the recessed portion in the front of the belt buckle blank.
11. Support the belt buckle blank in a horizontal orientation with picture side up and pour a previously prepared epoxy resin or ultraviolet radiation curable liquid over the picture until the liquid overflows and coats the raised lip and edge of the belt buckle blank.
12. Allow the resin to cure, or cure the ultraviolet radiation curable liquid with ultraviolet radiation.
13. After the curing step is complete, remove the tape, silicon bead, and excess coating from the back of the belt buckle blank.
14. Spray paint the previously removed belt loop and attach it to the back of the belt buckle.

The product which is the result of this process is a belt buckle with a recessed central area in which a picture or other decorative element is mounted. The picture, the raised lip surrounding the picture and all sides of the belt buckle are covered by a hard clear coating protecting the picture and adjacent surfaces from abrasion and inadvertent removal during use.

In the process described hereinabove, the bead of silicon around the back edge of the belt buckle blank serves to prevent the liquid epoxy resin or ultraviolet radiation curable liquid from extending across the back side of the belt buckle blank. Instead, when the liquid epoxy resin or ultraviolet radiation curable coating reaches the silicon bead, it simply drips off the buckle as waste material. The final clean-up of the finished belt buckle after the curing step is simplified by virtue of this feature.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
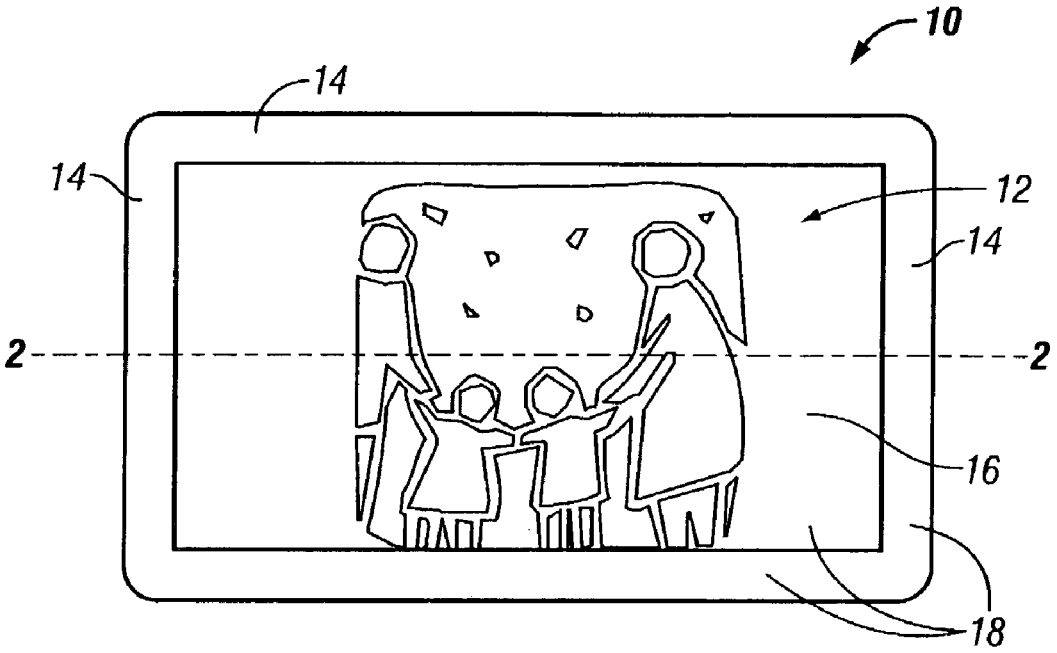
FIG. 1 is a plan view of a picture belt buckle in accordance with the present invention, prepared by the process of the invention.
Figure 2:
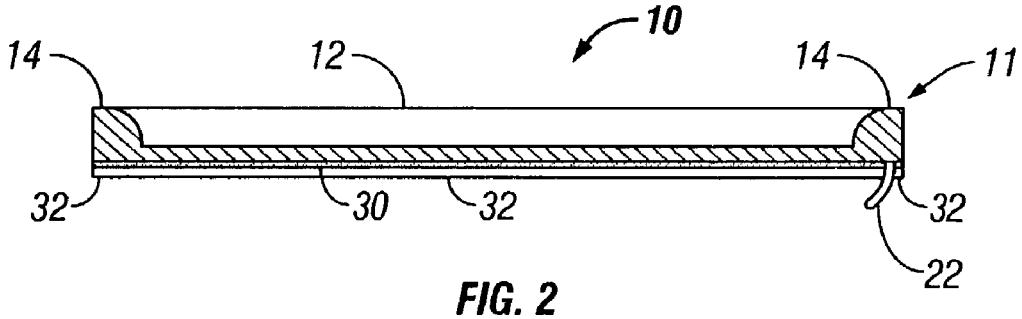
FIG. 2 is a cross-sectional view of the belt buckle of FIG. 1, taken along the line 2—2 therein, showing the buckle at an intermediate stage in the fabrication process.
Figure 3:
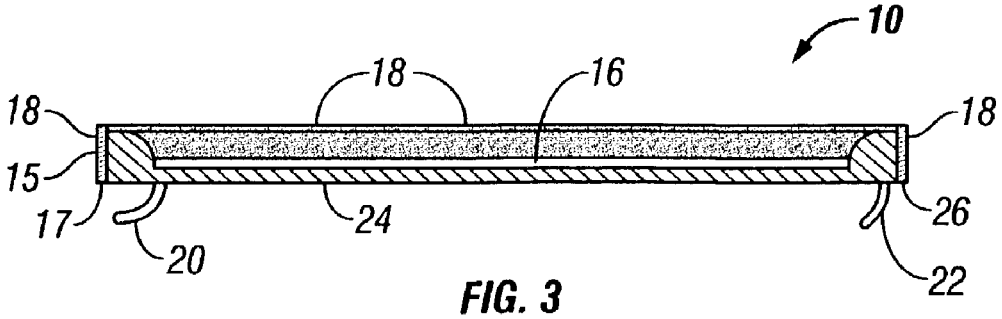
FIG. 3 is a sectional view of the belt buckle of FIG. 1, taken along the line 2—2 and showing the buckle in the finished state.

The belt buckle 10 of the present invention is shown in FIGS. 1–3 as having a central recessed area 12 surrounded by a raised rim or edge 14. In FIGS. 1 and 3, the recessed area 12 is shown covered by a photograph 16 trimmed to fit within the frame formed by the raised peripheral edges 14. Reference numeral 18 indicates epoxy resin coating or ultraviolet radiation curable liquid which extends over the picture and over the peripheral edges 14. In FIG. 3, the epoxy resin or ultraviolet radiation curable liquid coating 18 is shown exaggerated in thickness to make it visible. The recessed area 12 is filled with resin to the level of the edges 14 as indicated by the dotted portion.

FIG. 2 is a sectional view, taken along the line 2—2 of FIG. 1, of the picture belt buckle 10 but showing the belt buckle in partially fabricated form. In FIG. 3, a belt buckle blank 11 having a recessed area 12 surrounded by raised edges 14 is shown with a loop 20 and hook 22 projecting from the underside or back of the buckle. Depending upon the particular belt buckle blank that is used, the location and configuration of the loop 20 and hook 22 may vary. Both the loop 20 and the hook 22 may vary in position by differing distances from the respective ends of the belt buckle 11. Moreover, the length and shape of the loop 20 may vary. The loop is typically from one to four times the length of the hook 22 and may be situated up to about one-third of the length of the buckle from its adjacent end 15. A layer of adhesive-backed tape 30 is shown applied to the back 24 of the belt buckle blank 11. A silicon bead 32 is shown applied to the tape 30 about the peripheral edge of the belt buckle blank 11. The silicon bead 32 is located at the very peripheral edges of the back of the blank 11.

As indicated in FIG. 3, after the epoxy resin layer or ultraviolet radiation coating 18 has been applied and permitted to cure, and after the adhesive tape layer 30 with silicon bead 32 thereon has been removed from the backside of the buckle 10, the coating 18 remains in place, coating the photograph 16 and all exposed surfaces along the raised rim 14 and sides 15, terminating at the corner angles 17 which are between the back 24 and the sides 15. The result is a functional belt buckle having a glossy coating covering all visibly exposed surfaces and extending over the photograph which is mounted in the recessed area. The coating fills the recessed region, flush with the peripheral edges 14, adding depth to the photograph in an extremely attractive display.

What is claimed is:

1. A belt buckle for mounting a picture thereon, said buckle comprising:

a pre-formed belt buckle blank having a recessed central area surrounded by a raised lip on the front side of the buckle;

a picture sized to fit within said recessed area;

a coating of a cured-in-place clear material covering the picture and filling the recessed central area of the blank;

an elongated loop on the back of the buckle adjacent one end thereof, said loop being shaped to receive one end of a belt through the loop such that said one end of the belt folds about an outer portion of said loop to secure the belt to said one end of the belt, the free end of the belt forming at least one hole;

means for affixing said loop to the back of the buckle along an inner portion of the loop adjacent one end of the buckle; and a rearwardly projecting pin member affixed to the other end of said buckle remote from said loop for engaging the free end of said belt to secure the belt about the waist of a wearer.

2. The belt buckle of claim 1 wherein the belt buckle blank is formed of metal.

3. The belt buckle of claim 2 wherein said means for affixing said loop to the belt buckle blank is by brazing.

4. The belt buckle of claim 1 wherein said belt buckle blank is planar in shape.

5. The belt buckle of claim 2 wherein said metal is brass.

6. The belt buckle of claim 1 wherein said belt buckle blank is shaped to have a rectangular outline.

7. The belt buckle of claim 1 wherein said coating extends over the raised lip and down along the sides of the belt buckle blank to terminate short of the back side of the belt buckle blank.

8. The belt buckle of claim 1 wherein said coating forms a planar outer surface which is even with the outer termination of said raised lip.

9. The belt buckle of claim 1 wherein the picture, the raised lip surrounding the picture and all sides of the belt buckle blank are covered by a hard clear coating to protect the picture and adjacent surfaces from abrasion.

10. The belt buckle of claim 1 wherein the belt buckle blank is spray painted to a desired color.

11. The belt buckle of claim 1 wherein said coating is an epoxy resin, applied in liquid form and cured to develop a hard, clear overlayer.

12. The belt buckle of claim 11 wherein the coating comprises an ultraviolet radiation curable second coating formed as a top layer and applied over the epoxy resin coating.

13. The belt buckle of claim 1 wherein the coating includes an ultraviolet-radiation inhibitor applied as a coating layer along the front side of the picture to protect the picture from fading due to exposure to ultraviolet light.

14. The belt buckle of claim 1 wherein said hook is affixed to the belt buckle blank by brazing at a point adapted to engage the free end of the belt through a hole which is located along the centerline of the belt.

15. The belt buckle of claim 1 wherein said means for affixing said loop to the belt buckle blank is by adhesive.

16. The belt buckle of claim 1 wherein said loop and said buckle blank are formed of a fusible material and wherein said means for affixing said loop to the belt buckle blank is by fusing.

* * * * *